US011175628B2

(12) United States Patent
Bifrare et al.

(10) Patent No.: US 11,175,628 B2
(45) Date of Patent: Nov. 16, 2021

(54) REPEATER WITH A CHAIN WOUND ON A CAM

(71) Applicant: Montres Breguet S.A., L'Abbaye (CH)

(72) Inventors: Christophe Bifrare, Le Pont (CH); Alain Zaugg, Le Sentier (CH)

(73) Assignee: Montres Breguet S.A., L'Abbaye (CH)

( * ) Notice: Subject to any disclaimer, the term of this patent is extended or adjusted under 35 U.S.C. 154(b) by 469 days.

(21) Appl. No.: 16/205,293

(22) Filed: Nov. 30, 2018

(65) Prior Publication Data

US 2019/0196410 A1 Jun. 27, 2019

(30) Foreign Application Priority Data

Dec. 22, 2017 (EP) ..... 17209993

(51) Int. Cl.
*G04B 21/12* (2006.01)
*G04B 21/04* (2006.01)

(52) U.S. Cl.
CPC ..... *G04B 21/12* (2013.01); *G04B 21/04* (2013.01)

(58) Field of Classification Search
CPC ..... G04B 21/04; G04B 21/12; G04B 21/02; G04B 21/027; G04B 21/06; G04B 21/14; G04B 23/00; G04B 23/03
See application file for complete search history.

(56) References Cited

U.S. PATENT DOCUMENTS

| | | | | |
|---|---|---|---|---|
| 593,274 | A | 11/1897 | Hahlweg | |
| 8,873,347 | B2 * | 10/2014 | Goeller | G04B 21/00 368/261 |
| 10,514,660 | B2 * | 12/2019 | Behra | G04B 21/04 |
| 2019/0196409 | A1 * | 6/2019 | Bifrare | G04B 21/14 |
| 2019/0204785 | A1 * | 7/2019 | Bifrare | G04B 21/12 |

FOREIGN PATENT DOCUMENTS

CH 707 271 A2 5/2014

OTHER PUBLICATIONS

European Search Report dated Jun. 8, 2018 in European Application 17209993.9 filed on Dec. 22, 2017 (with English Translation of Categories of Cited Documents).

* cited by examiner

*Primary Examiner* — Edwin A. Leon
*Assistant Examiner* — Jason M Collins
(74) *Attorney, Agent, or Firm* — Oblon, McClelland, Maier & Neustadt, L.L.P.

(57) ABSTRACT

A repeater mechanism includes an hour snail, an hour rack carrying an hour beak and rotatably mounted about an hour axis between a rest position and a read position, an hour spring, which returns the hour rack to its read position, a pulley rotatably mounted about a pulley axis and which forms a spiral-shaped peripheral cam path, a chain able to be wound on the pulley, the chain being hooked on the pulley and on the hour rack, and a return spring coupled to the pulley and via which the pulley pulls the hour rack, via the chain, into its rest position.

7 Claims, 10 Drawing Sheets

FIG.7
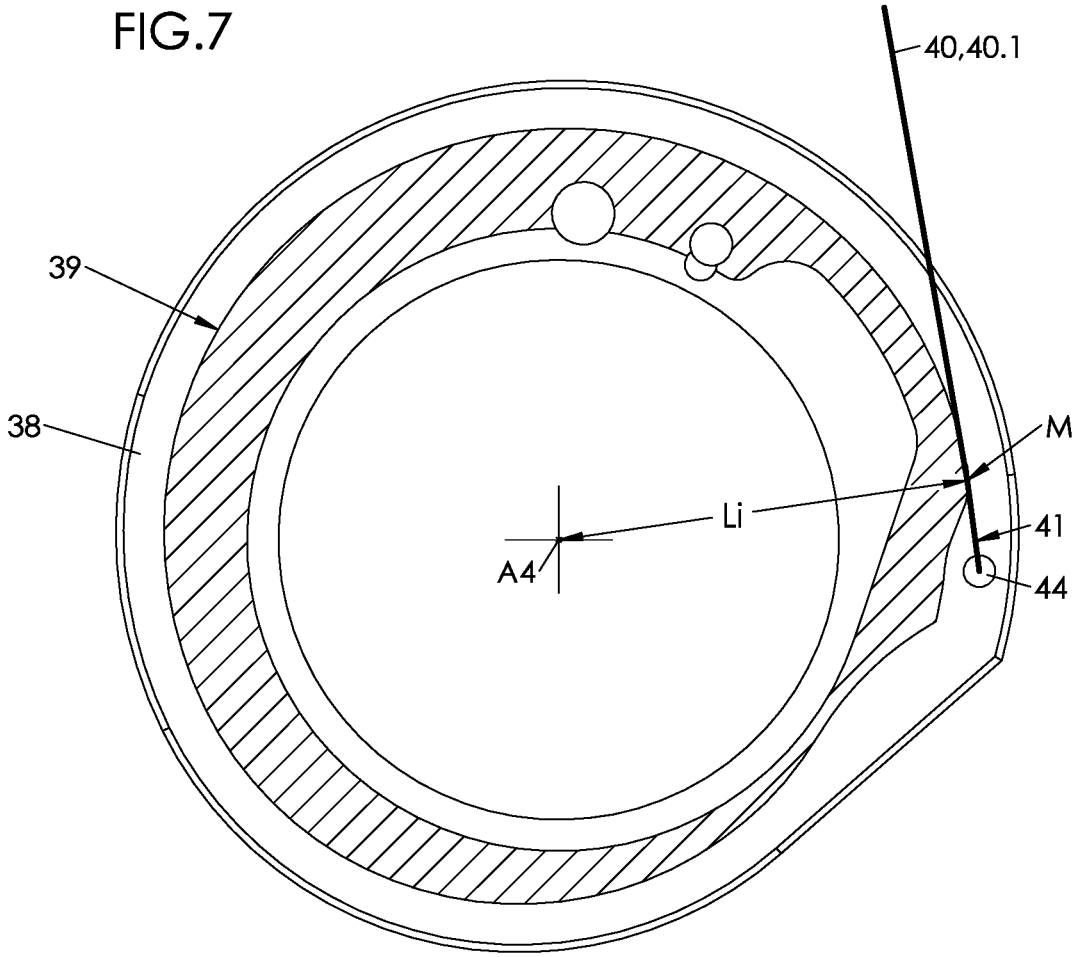
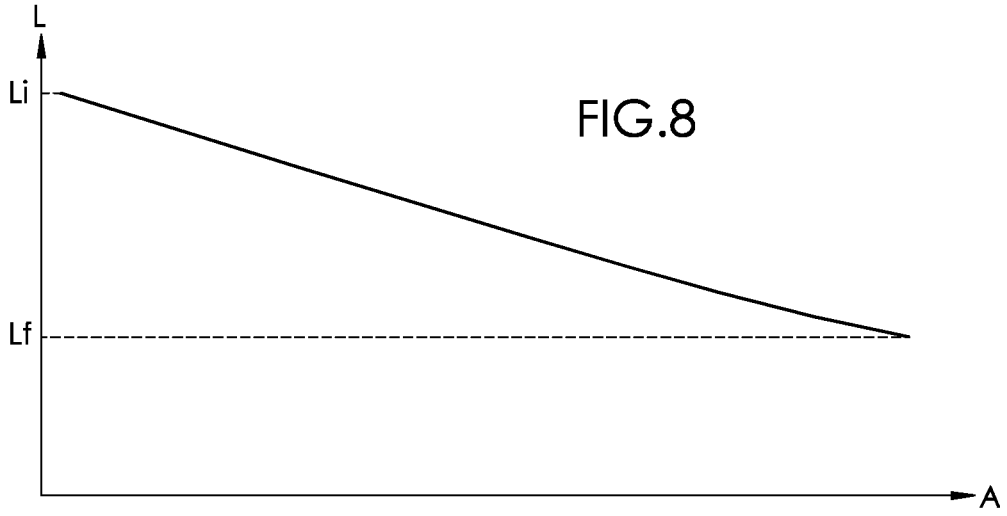
FIG.8

REPEATER WITH A CHAIN WOUND ON A CAM

CROSS-REFERENCE TO RELATED APPLICATION

This application claims priority to European Patent Application No. 17209993.9 filed on Dec. 22, 2017, the entire disclosure of which is hereby incorporated herein by reference.

FIELD OF THE INVENTION

The invention concerns the field of horology. It more specifically concerns a repeater mechanism for a striking timepiece; the term 'timepiece' preferably refers to watch (a wristwatch or fob watch) but may also refer to a pendulum or other clock.

PRIOR ART

The purpose of the repeater mechanism (usually simply called a 'repeater') is to strike, at the request of the user (or wearer)—by depressing a pusher at any time—the time indicated at that moment by the hands of the timepiece.

The repeater is an extremely sophisticated horological complication. Formerly intended to allow the time to be determined in the dark, the repeater is nowadays fitted to high or extremely high value watches.

There are several types of repeater. In *Les Montres Compliquées* (A Guide to Complicated Watches) (Ed. Simonin, fifth edition, 2013), F. Lecoultre lists five, but singles out two (the most common):

- the minute repeater, which chimes all the minutes as well as the hours,
- the quarter repeater, which chimes the quarter(s) since the last hour and then any remaining minutes, as well as the hours.

Regardless of the type, the minute repeater traditionally includes:

- at least one hour snail,
- at least one hour rack carrying an hour beak and rotatably mounted about an hour axis between:
  - a rest position in which the hour beak is angularly separated from the hour snail, and
  - a 'read' position in which the hour beak comes into contact with the hour snail,
- an hour spring which returns the hour rack to its read position,
- and a striking barrel, coupled to the hour rack to return the latter to its rest position.

In the absence of action by the user, the hour rack is in its rest position.

Displacement of the pusher causes a forced rotation of the striking barrel, the hour rack itself is then moved to its read position against the spring.

Releasing pressure on the pusher causes the hour rack to return to its rest position. On the way, the hour rack engages (directly or indirectly) with a hammer striking a gong a number of times equal to the number of hours 'read' on the snail and proportional to the angular distance travelled by the hour rack between its two positions (read, rest).

In the so-called old repeating mechanism, the coupling of the barrel to the hour rack was achieved by means of a lever and a chain, as explained by F. Lecoultre (op.cit., pp 68-69 and FIG. 19, plate 17).

In modern repeaters, this coupling has been replaced by a repeating rack and a train, as also explained by F. Lecoultre (op.cit., pp.73-74). Two opposing springs are provided: a mainspring which drives the hour rack to its rest position, and an hour spring which drives it to its read position. Actuation of the barrel by the user, by winding the mainspring, releases the hour spring which returns the hour rack to its read position. Releasing the barrel, conversely, releases the mainspring, which returns the hour rack to its rest position (against the hour spring), while the hour is being chimed.

A new repeater mechanism has recently been proposed, which is fitted to the Breguet watch model 7087 "Tradition", and in which the train is replaced by a chain transmission.

This transmission is not to be confused with the chain of the old repeating mechanism mentioned above, since it works the other way round.

More specifically, in this repeater, the barrel includes:

- a barrel arbor,
- a barrel drum.
- a mainspring, an inner end of which is integral with the barrel arbor and an outer end of which is integral with the barrel drum,
- a pulley, rotationally coupled to the barrel arbor and on which the chain is wound.

The chain is hooked, by a proximal end, on the pulley and, by a distal end, on the hour rack. In the absence of action by the user on the pusher, the mainspring stretches the chain which holds the hour rack in its rest position. Action by the user on a pusher causes the forced rotation of the barrel arbor, which releases the chain and thus the hour rack, which is returned to its read position by the hour spring.

When the user releases the pusher, the mainspring, which exerts a drive torque on the barrel arbor greater than the resistance torque exerted by the hour spring on the hour rack, returns the latter to its rest position. On its way, the hour is struck.

The reading (and chiming) of the quarters and/or minutes follows the same principle, with a quarter snail (respectively a minute snail) and a quarter rack (respectively a minute rack) carrying a quarter beak (respectively a minute beak) capable of coming into contact with the quarter snail (respectively the minute snail) in a read position.

This mechanism has an advantage in terms of compactness and assembly. Indeed, the chain, which forms the mechanical connection between the barrel on the one hand and the hour rack on the other, makes it possible to position said components away from each other. Thus, regardless of the position of the hour rack inside the case middle, it is possible to place the barrel very close to the pusher, which avoids having to use complex intermediate wheels and levers, to the benefit of the reliability of the watch.

However, slight variations in the frequency of the chimes are noted in this mechanism during the strike function. It is known to provide the mechanism with a regulator, which partly offset these variations. However, a precise measurement shows that despite the regulator, the frequency of the chimes is not perfectly constant.

Consequently, a first object, in a chain repeater mechanism, is to further minimise frequency variations in the repeater chimes.

It is a second object, more specifically, to minimise variations in the forces to which the chain is subjected.

SUMMARY OF THE INVENTION

To this end, there is proposed, firstly, a repeater mechanism for a striking timepiece, which includes:

an hour snail, an hour rack carrying an hour beak and rotatably mounted about an hour axis between:

- a rest position in which the hour beak is angularly separated from the hour snail,
- a 'read' position in which the hour beak comes into contact with the hour snail, an hour spring, which returns the hour rack to its read position, a pulley rotatably mounted about an axis and which defines a peripheral cam path which extends in a spiral around said axis, a chain able to be partially wound on the pulley, the chain being hooked, by a proximal end, on the pulley, and by a distal end, on the hour rack, a return spring coupled to the pulley, and by means of which the pulley pulls the hour rack into its rest position, via the chain.

By means of the cam path, it is possible to offset variations in the drive torque generated by the mainspring on the barrel arbor, which makes it possible to minimise variations in the traction force generated on the chain by the pulley. This results in chimes of extremely regular frequency during the strike function.

Various additional characteristics can be provided, alone or in combination.

Thus, for example, the pulley and the chain jointly form, on the cam path, a contact point whose distance to the barrel arbor decreases with the winding of the chain. In this case, the cam path can offset the decrease in drive torque generated by the mainspring.

The variation in distance from the contact point to the barrel arbor varies in a proportion preferably comprised between 5% and 20%.

The variation in distance to the pulley axis as a function of the winding of the chain is advantageously linear.

According to a particular embodiment, the repeater mechanism includes:

a striking barrel including:

- a barrel arbor which defines a barrel axis coincident with the pulley axis,
- a barrel drum.
- a mainspring, an inner end of which is integral with the barrel arbor and an outer end of which is integral with the barrel drum, the pulley rotationally coupled to the mainspring.

Secondly, there is proposed a timepiece, such as a watch, fitted with a repeater mechanism as presented above.

BRIEF DESCRIPTION OF THE DRAWINGS

Other features and advantages of the invention will appear in light of the following description of one embodiment, made with reference to the annexed drawings, in which:

FIG. 7 is a detail sectional view, in the same plane as FIG. 5, showing the pulley in a position of complete unwinding of the chain, which is represented in a bold line.

FIG. 8 is a diagram showing the variations in distance, at the centre of rotation of the pulley, from the point of contact with the chain.

DETAILED DESCRIPTION OF THE INVENTION

Figure 1:
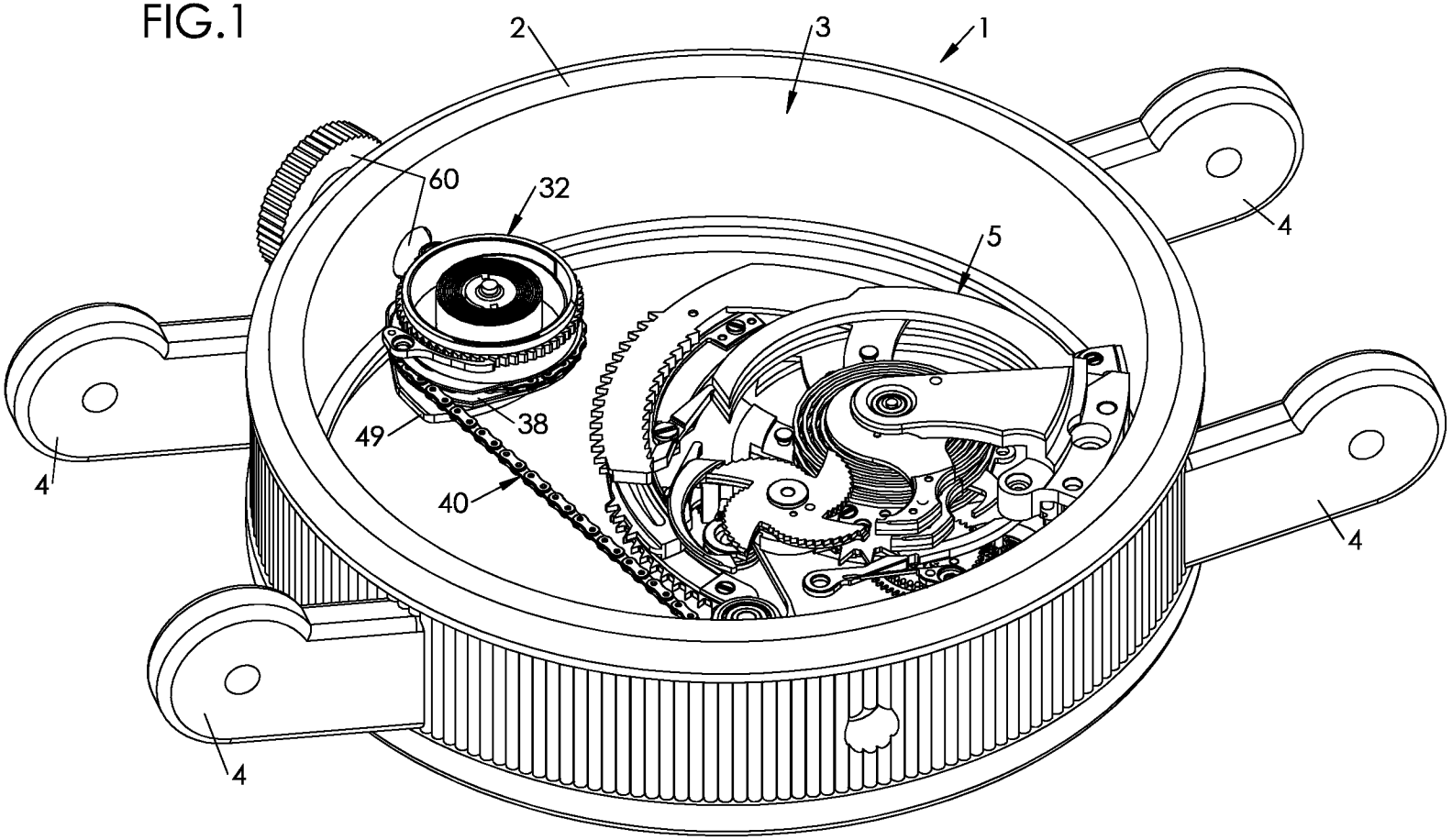
FIG. 1 is a perspective view partially showing a watch provided with a repeater mechanism.

FIG. 1 partially represents a timepiece, in this case a watch 1. Watch 1 includes a case middle 2 which forms an internal volume 3. In the illustrated example, watch 1 is designed to be worn on the wrist, and its case middle 2 includes for this purpose projecting horns 4, to which a bracelet (not represented) is intended to be attached.

Watch 1 includes a timepiece movement designed to indicate at least the hours and minutes. The movement includes a mainplate intended to be housed inside internal volume 3 formed by case middle 2, and to be secured therein.

The movement further includes various functional components grouped into sub-assemblies. When a sub-assembly has a function other than displaying the hours, minutes and, if applicable, the seconds, it is called a 'complication'.

Thus, the illustrated timepiece (i.e. watch 1) has a striking mechanism and, for the purpose of striking the current time, a repeater mechanism, also called a 'repeater complication' or more simply (as used hereinafter), 'repeater' 5.

Repeater 5 includes, firstly, at least one hour snail 6. This snail 6 is rotatably mounted on an axis A1. It has a generally spiral shape and includes on its rim a series of twelve angular sectors of decreasing distance to axis A1.

Hour snail 6 is integral in rotation with an hour star 7 which has twelve pointed teeth.

Figure 2:
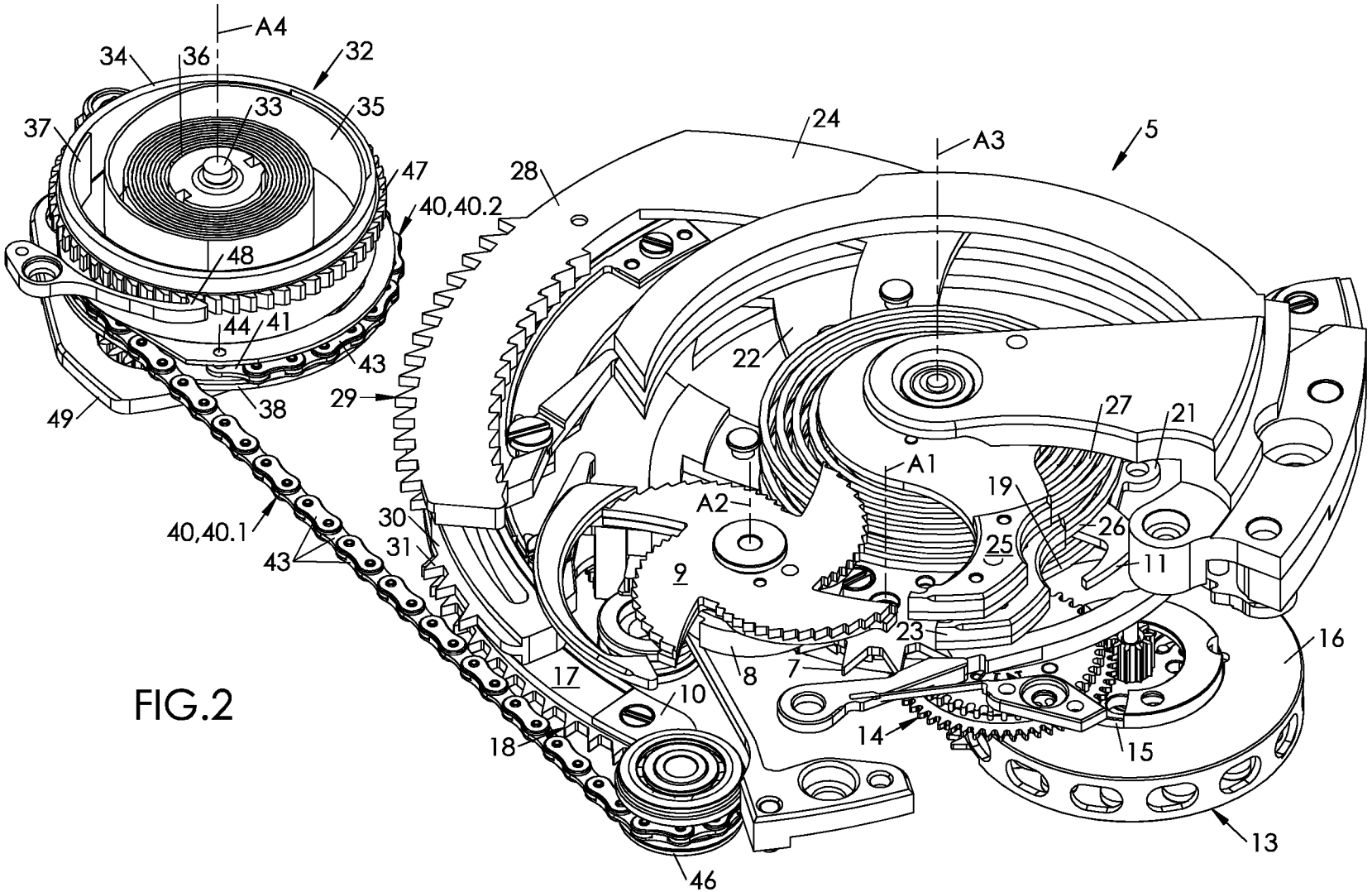
FIG. 2 is a perspective, larger scale view of the repeater mechanism on its own.

In the example illustrated in FIG. 2, repeater 5 also includes a quarter snail 8, rotatably mounted about an axis A2. Quarter snail 8 includes four angular sectors of decreasing distance to axis A2, separated by smooth joining surfaces.

Repeater 5 also includes a minute snail 9, integral in rotation with quarter snail 8 and which has four arms with notched edges, separated by smooth joining faces which extend in the extension of the joining surfaces of quarter snail 8.

Quarter snail 8 carries, close to its rim, a finger which, at each revolution, meshes with a tooth of hour star 7 to rotate the latter by one twelfth of a revolution representing a forward step of one hour.

Repeater 5 includes, secondly, an hour rack 10, rotatably mounted about an axis A3 and carrying an hour beak 11.

Figure 5:
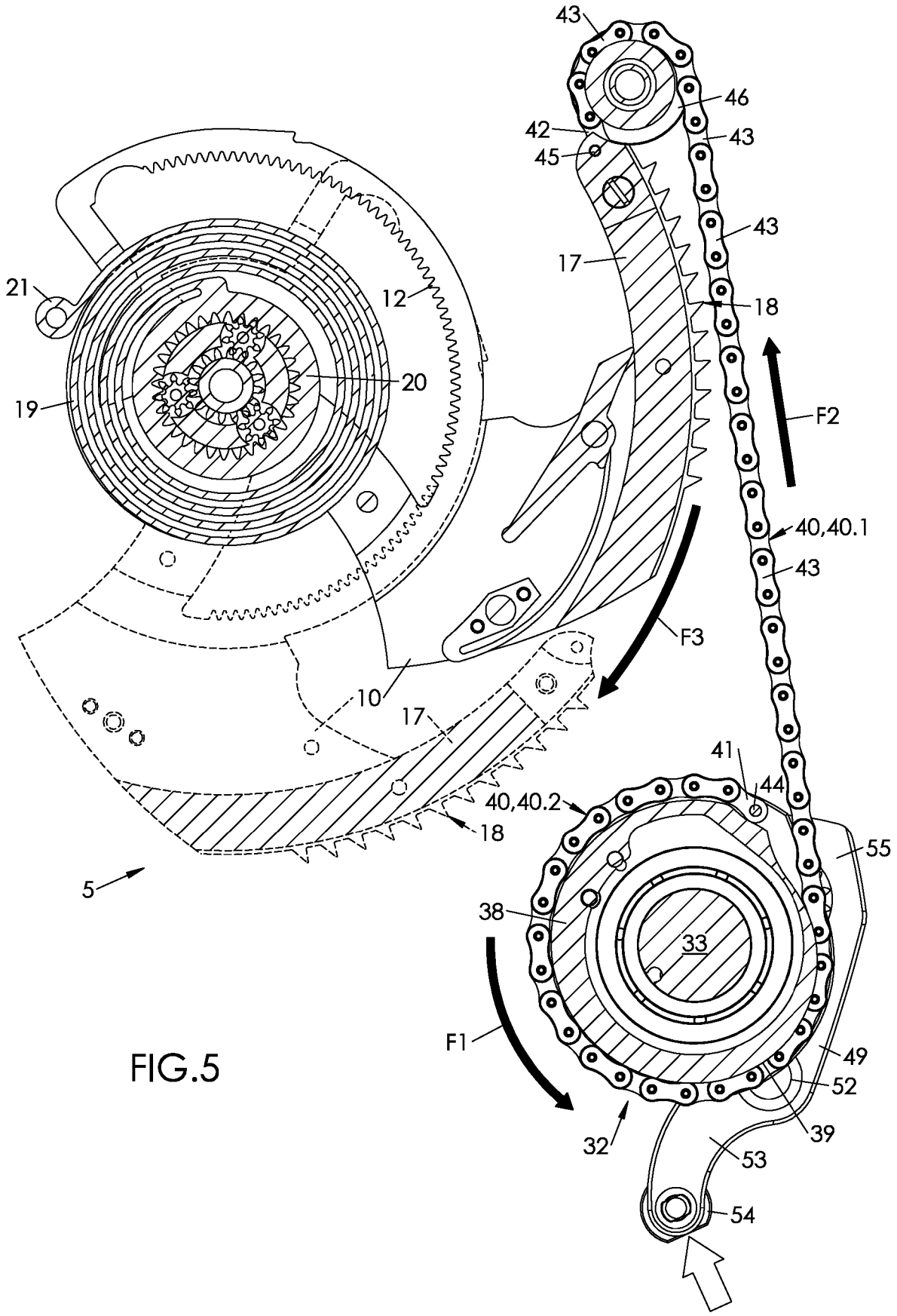
FIG. 5 is a partial, sectional view showing the repeater mechanism, on the sectional plane V-V of FIG. 3.

Hour rack 10 is rotatably mounted about its axis A3 between:

- a rest position (in a solid line in FIG. 5) in which hour beak 11 is angularly separated from hour snail 6, and
- a 'read' position (in dotted lines in FIG. 5) in which hour beak 11 comes into contact with hour snail 6.

Figure 3:
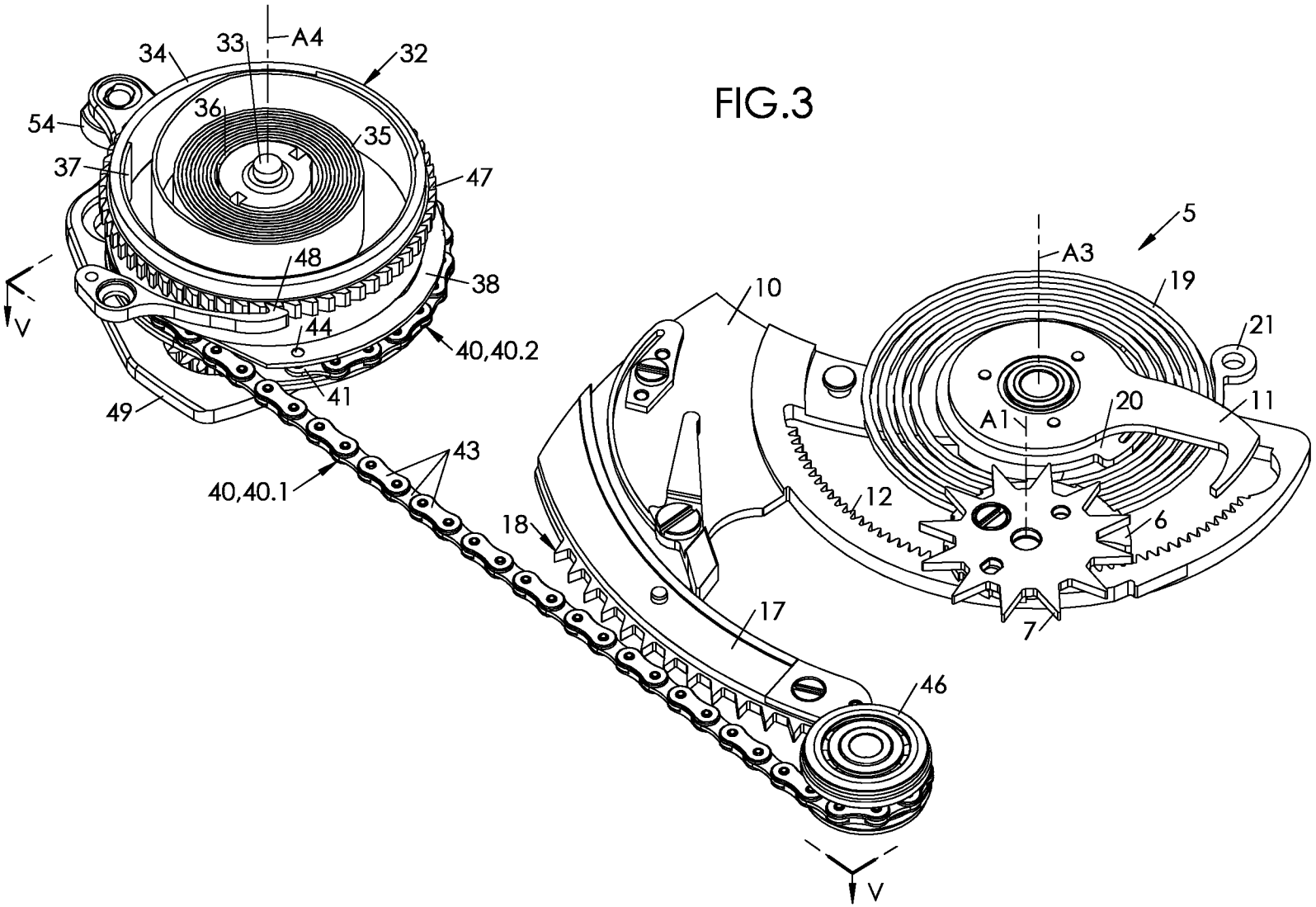
FIG. 3 is a perspective view of the repeater mechanism partially cut away to more clearly illustrate its structure and working.

As illustrated in FIG. 2 and FIG. 3, hour rack 10 includes a toothed sector 12 coupled to a regulator device (or regulator) 13 via a transmission train 14. In the illustrated example, regulator 13 includes a rotor 15 rotatably mounted in a stator 16.

Regulator 13 is preferably magnetic; in that case it includes a rotor 15 rotatably mounted in a stator 16. Rotor 15 has a maximum rotational speed, set by a balance between the centrifugal force applied to movable ferromagnetic inertia blocks mounted on rotor 15, and a counter-electromotive force generated in the inertia blocks by eddy currents induced by an alternating magnetic field produced by pairs of magnets contained in stator 16.

Hour rack 10 has an outer arm 17 provided with an hour rack toothing 18, comprising twelve protruding teeth. When hour rack 10 returns from its read position to its rest position, hour rack toothing 18 actuates an hour hammer (not represented) which strikes an hour gong tuned to a predetermined acoustic frequency, possibly amplified by a structural part of watch 1 (for example case middle 2). The hour hammer strikes the hour gong a number of times (comprised between one and twelve) equal to the number of teeth of hour rack toothing 18 which actuated the hammer when hour rack 10 returned from its read position to its rest position.

Repeater 5 includes, fourthly, an hour spring 19, which returns hour rack 10 to its read position. In the illustrated example, hour spring 19 is a spiral spring. It is advantageously fixed to hour rack 10 by an inner end 20, and to an arbor integral with the mainplate by an outer end 21.

Repeater 5 includes, in the example illustrated in FIG. 2, a quarter rack 22 carrying a quarter beak 23 and rotatably mounted about axis A3 between:

- a rest position in which quarter beak 23 is angularly separated from quarter snail 8, and
- a 'read' position in which quarter beak 23 comes into contact with quarter snail 8.

The repeater further includes, in the example illustrated in FIG. 2, a minute rack 24 carrying a minute beak 25 and rotatably mounted about axis A3 between:

- a rest position in which minute beak 25 is angularly separated from minute snail 9, and
- a 'read' position in which minute beak 25 comes into contact with minute snail 9.

The repeater further includes, in the example illustrated in FIG. 2, a minute rack 24 carrying a minute beak 25 and rotatably mounted about axis A3 between:

- a rest position in which minute beak 25 is angularly separated from minute snail 9, and
- a 'read' position in which minute beak 25 comes into contact with minute snail 9.

Repeater 5 also includes a quarter spring 26 which returns quarter rack 22 to its read position, and a minute spring 27 which returns minute rack 24 to its read position.

Minute rack 24 is provided, on an outer arm 28, with a minute rack toothing 29, comprising fourteen protruding teeth. When minute rack 24 returns from its read position to its rest position, minute rack toothing 29 actuates a minute hammer (not represented) which strikes a minute gong tuned to a different predetermined acoustic frequency (for example lower-pitched) from the acoustic frequency of the hour gong. The minute hammer strikes the minute gong a number of times (comprised between one and fourteen) equal to the number of teeth of minute rack toothing 29 which actuated the hammer when minute rack 24 returned from its read position to its rest position.

Quarter rack 22 is provided, on an outer arm 30, with a quarter rack toothing 31, comprising three series of protruding teeth. When quarter rack 22 returns from its read position to its rest position, quarter rack toothing 31 actuates the hour hammer and the minute hammer almost simultaneously to produce a close sequence of two notes. The hour hammer and the minute hammer strike their respective gongs a number of times (comprised between zero and three) equal to the number of series of teeth of quarter rack toothing 31 which actuated said hammers when quarter rack 22 returned from its read position to its rest position.

As seen in FIG. 2, hour rack 10, quarter rack 22 and minute rack 24, rotatably mounted on the same axis A3, are angularly spaced apart with respect to each other, such that, during their integral rotation about axis A3, readings are taken in succession in the following order: minutes; quarters, hours. However, the striking function is performed in the reverse order: hours, quarters, minutes.

Repeater 5 includes, fifthly, a striking barrel 32.

Striking barrel 32 is rotatably mounted about an axis A4. Striking barrel 32 is a sub-assembly which includes several components, including the following:

- a barrel arbor 33,
- a barrel drum 34,
- a mainspring 35, whose inner end 36 is integral with barrel arbor 33 and outer end 37 is integral with barrel drum 34, and
- a pulley 38 forms a peripheral cam path 39.

Barrel arbor 33 and barrel drum 34 are both rotatably mounted about barrel axis A4.

Pulley 38 is rotationally coupled to barrel arbor 33. Pulley 38 is mounted about an axis of rotation which is coincident here with barrel axis A4.

Repeater 5 includes, sixthly, a chain 40 capable of being partially wound on pulley 38, and more specifically on cam path 39. Chain 40 is hooked by a proximal end 41 on pulley 38 and by a distal end 42 on hour rack 10.

Chain 40 includes a plurality of links 43 articulated to each other. The link 43 situated at proximal end 41 of chain 40 is fixed to a pin 44 integral with pulley 38. The link 43 situated at distal end 42 of chain 40 is fixed to a pin 45 integral with outer arm 17 of hour rack 10.

According to an embodiment illustrated in FIGS. 2 to 5, repeater 5 includes an intermediate bearing 46 on which chain 40 moves, between striking barrel 32 and hour rack 10. This intermediate bearing 46 advantageously takes the form of a rolling bearing (for example a ball bearing).

Figure 4:
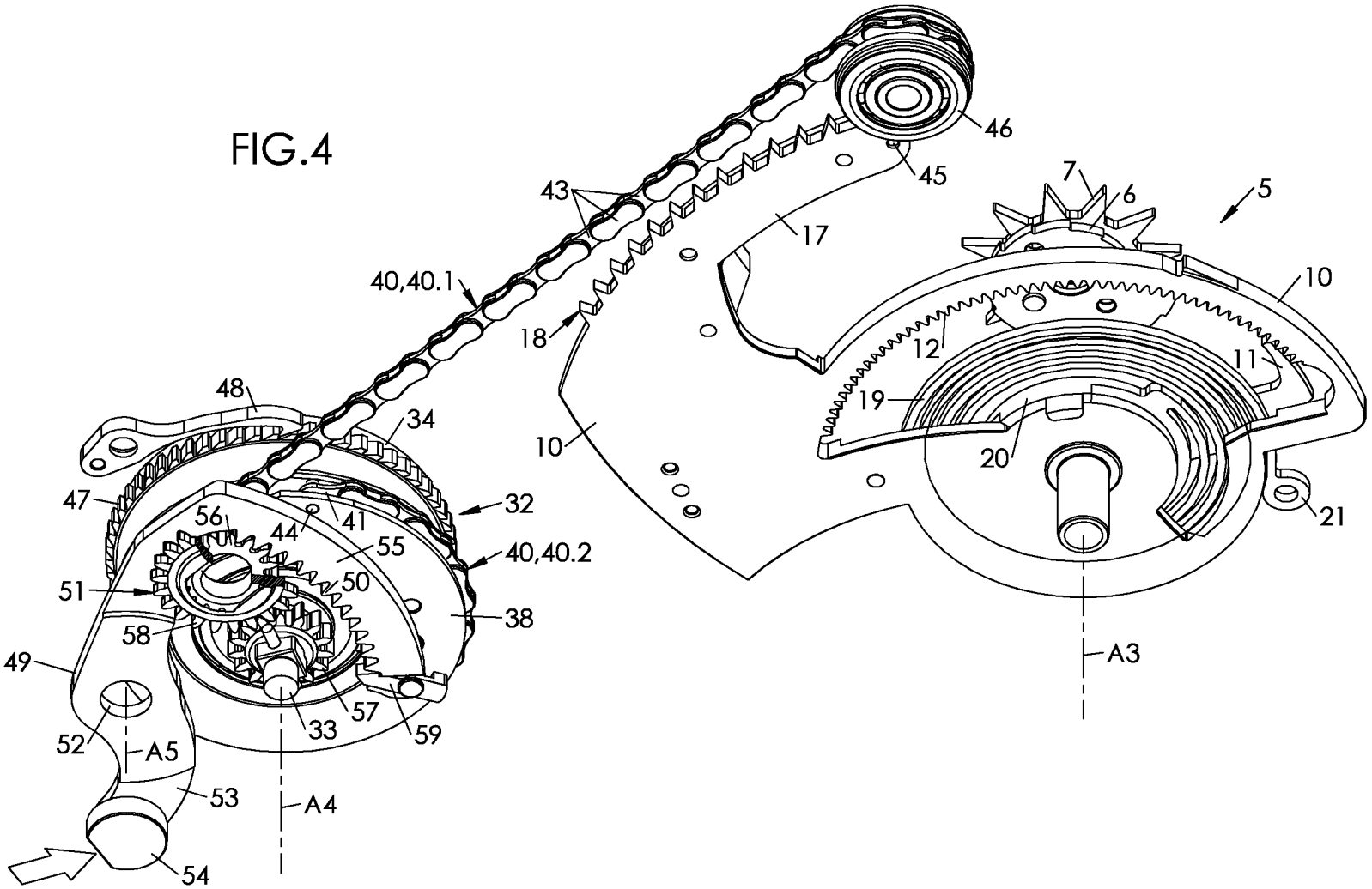
FIG. 4 is a perspective view of the mechanism of FIG. 3, viewed from different angle.

As illustrated in FIGS. 2 to 4, barrel drum 34 carries, on its edge, a toothed crown 47 with asymmetrical teeth, and repeater 5 includes a locking click meshed with toothed crown 47, to prevent barrel drum 34 rotating in the direction of unwinding of chain 40.

As represented in FIG. 4, repeater 5 includes, in seventh place:

- a repeating rack 49 rotatably mounted about a fixed repeating rack axis A5, and provided with a toothed sector 50,
- a striking train 51 in mesh, on the one hand, with repeating rack 49, and on the other, with barrel arbor 33.

Repeating rack 49 is hook-shaped. Repeating rack 49 is provided with a bore 52 by means of which it is mounted on its axis A5. On either side of bore 52, repeating rack 49 has a lever 53 carrying at the end thereof a button 54 (which, in the illustrated example is an added part pressed into a hole formed in the end of lever 53), and a bent arm 55 in which toothed sector 50 is formed.

Repeating rack 49 is rotatably mounted about its axis A5 between a rest position (FIG. 4) and a completely wound position.

According to an embodiment illustrated in FIG. 4, striking train 51 includes an input pinion 56 meshing with repeating rack 49, and an output pinion 57 integral in rotation with barrel arbor 33.

In the illustrated example, striking train 51 also includes a transmission pinion 58 (partially cut away in FIG. 4) integral in rotation with input pinion 56 and meshing with output pinion 57.

As also shown in FIG. 4, repeating rack 49 is advantageously provided, at the free end of toothed sector 50, with an end stop 59, which takes the form here of an additional pressed-in part, and which, in the completely wound position of repeating rack 49, is wedged against input pinion 56 which thus forms an end-of-travel stop for said rack.

As illustrated in FIG. 1, watch 1 is provided with a pusher 60. This pusher 60 is mounted in translation with respect to case middle 2 between:

- a non-actuated position in which pusher 60 does not exert drive torque on repeating rack 49, and
- an actuated position in which pusher 60 exerts on repeating rack 49, via button 54, a thrust force (indicated by the white arrow at the bottom left of FIG. 4 and at the bottom right of FIG. 5) generating a drive torque which drives in rotation barrel arbor 33 via striking train 51.

Repeater 5 is actuated by a finger pressing pusher 60. Pusher 60 pushes back button 54 which, via lever 53, causes repeating rack 49 to pivot about its axis A5. Repeating rack 49 drives in rotation input pinion 56, via the meshing of its toothed sector 50, said rotation is transmitted by transmission pinion 58, which is integral with input pinion 56, to output pinion 57, which, as it rotates, drives barrel arbor 33 (in the direction of arrow F1 in FIG. 5) together with pulley 38 which is integral therewith. Repeating rack 49 and the components that it drives, are forced to rotate against the return torque imposed by mainspring 35, whose inner end 36 rotates with barrel arbor 33, while its outer end 37 remains immobile with barrel drum 34, locked by click 48 in mesh with toothed crown 47. Consequently, it is clear that the rotation of repeating rack 49 has the effect of winding mainspring 35.

Chain 40 pulled (in the direction of arrow F2 in FIG. 5) on its distal end side 42 by hour rack 10, which is itself rotated back (in the direction of arrow F3 in FIG. 5) to its read position by hour spring 19, is unwound from pulley 38.

When it reaches the read position, in which hour beak 11 comes into contact with hour snail 6, hour rack 10 is stopped, while, if applicable, quarter rack 22 and minute rack 24 can continue their rotation, respectively returned to their read positions by quarter spring 26 and minute spring 27, until quarter beak 23 and minute beak 25 come into contact respectively with quarter snail 8 and minute snail 9.

Releasing pusher 60 releases mainspring 35, whose outer end 37 remains fixed with barrel drum and whose inner end 36 drives in rotation barrel arbor 33 (in the opposite direction to arrow F1) and therewith pulley 38 (in the same direction of rotation). Since the return torque imposed on the pulley by mainspring 35 is higher (or much higher) than the resistance torque applied to hour rack 10 by hour spring 19, pulley 38 pulls chain 40 (in the opposite direction to arrow F2), which winds around the pulley, driving hour rack 10 therewith in rotation about its axis A3 (in the opposite direction to arrow F3), until hour rack 10 reaches its rest position, which it achieves by bearing against intermediate bearing 46, which locks repeater 5.

During the movement that accompanies the release of pusher 60, hour rack 10, quarter rack 22 and minute rack 24 have together (as explained above), chimed the displayed time.

Repeater 5 is provided with regulator 13 so that the striking function is performed at a frequency that is as regular as possible.

However, regulator 13 is not sufficient, since the drive torque, referenced C, induced on barrel arbor 33 by mainspring 35, is not constant as a function of the angular position, referenced A, of pulley 38, measured with reference to the wound position (where, by convention, A=0). In the following description, this angular position A is referred to as the 'pulley angle'.

As seen in FIGS. 2 to 5, chain 40 has a straight section 40.1, which extends between pulley 38 and intermediate bearing 46, and a curvilinear section 40.2, wound around pulley 38 (and more exactly around cam path 39) in the extension of straight section 40.1.

Pulley 38 and chain 40 together form, on cam path 39, a contact point M. This contact point M is located at the boundary of the winding of the chain 38.

Contact point M is the point on cam path 39 where chain 40 starts to be wound on pulley 38 or, in other words, the point where chain 40 leaves pulley 38. This means that contact point M is located at the junction between straight section 40.1 and curvilinear section 40.2. Depending on the angular position of pulley 38, the location of point M on cam path 39 shifts.

Drive torque C is transmitted by barrel arbor 33 to pulley 38, which is rotationally coupled about barrel axis A4. Pulley 38 in turn exerts a traction force, referenced T, owing to drive torque C generated by mainspring 35. This traction force T is applied to contact point M, in line with straight section 40.1. The distance from contact point M to barrel axis A4 is referenced L and called the 'lever arm'.

Given these references, traction force T is deduced from torque C by the following conventional formula:

$$T = \frac{C}{L}$$

Since drive torque C is not constant along pulley angle A, this means that if lever arm L were constant, traction force T would not be constant either along pulley angle A.

This is the function of cam path 39: to vary lever arm L to offset the variation in torque C and thus minimise variations in traction force T.

More specifically, it was observed that drive torque C decreases progressively as pulley angle A increases, starting from the unwound position (illustrated in FIG. 7).

This is why cam path 39 extends in a spiral around barrel axis A4. More specifically, lever arm L decreases with the winding of chain 40 (i.e. as pulley angle A increases). In other words, the distance to barrel axis A4 from contact point M is a decreasing function of pulley angle A.

Figure 11:
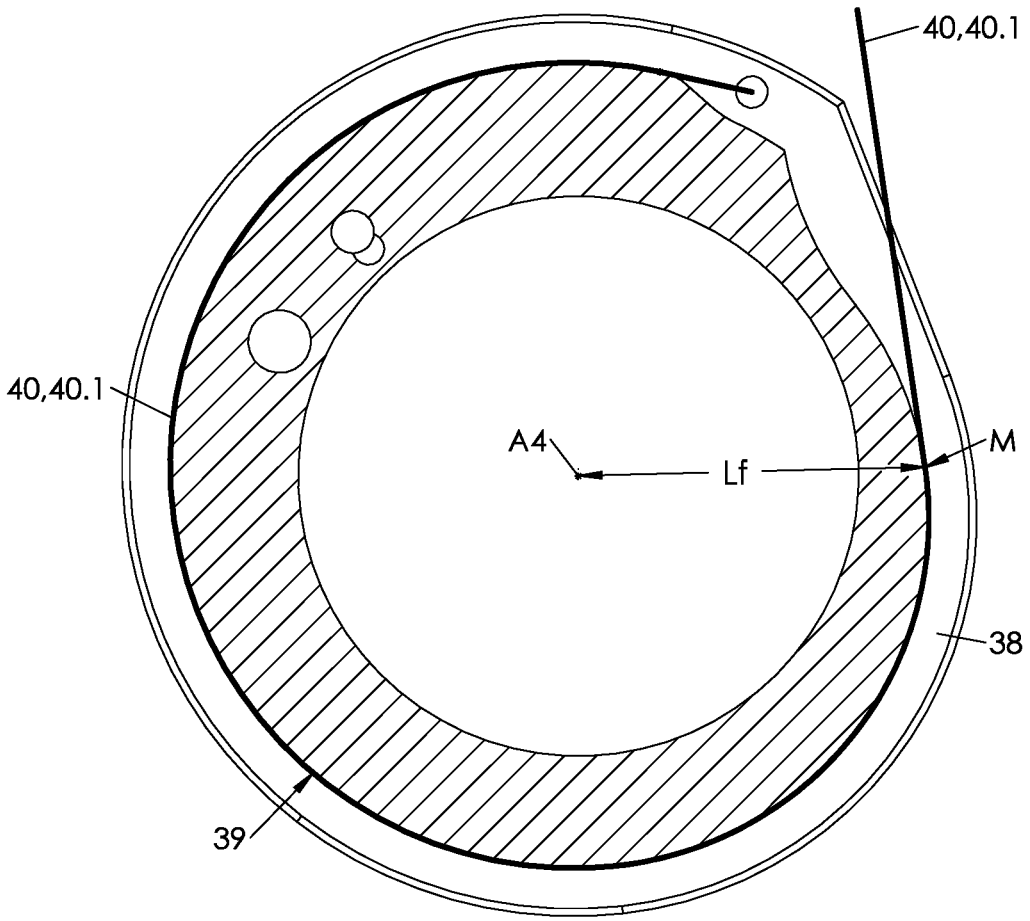

FIG. 8 shows a curve representing the variations in lever arm L (on the ordinate, where the axis is graduated in millimetres in the illustrated example) as a function of pulley angle A (on the abscissa, where the axis is graduated in degrees in the illustrated example). The ('initial') lever arm measured when pulley angle A is zero (in the unwound position corresponding to the unwinding of pulley 38, FIG. 8) is referenced Li, and the ('final') lever arm measured when angle A is maximum (in the wound position corresponding to the total winding of pulley 38, FIG. 11) is referenced Lf.

Lever arm L preferably varies in a proportion comprised between 5% and 20%. This variation may seem small, but it is sufficient to offset the variations in drive torque C and to make traction force T, applied to chain 40 by pulley 38 returned by mainspring 35, virtually constant.

In a particular embodiment:

Li≅3.85 mm

Lf≅3.30 mm

The variation in lever arm L is thus, in this example, approximately 14% but this example is not limiting since it depends on the performance of spring 35.

As already suggested, a deformed spring tends to return to a stable equilibrium configuration by generating a return torque that does not remain constant with deformation. A closer examination reveals that, generally speaking, the variation in return torque generated by a spring as a function of deformation is not linear overall, but may be locally.

It is thus clear that if spring 35 can be kept within a range of deformation where the torque variation generated is linear, it is possible to design a pulley 39 whose lever arm L also varies linearly as a function of pulley angle A. In other words, cam path 39 is in an Archimedes spiral.

Thus, in the example illustrated in FIG. 8, the variation of lever arm L as a function of pulley angle A is represented in a curve. It is seen that, in this example, lever arm L varies linearly as a function of pulley angle A, which corresponds to a cam path 39 in an Archimedes spiral.

Figure 6:
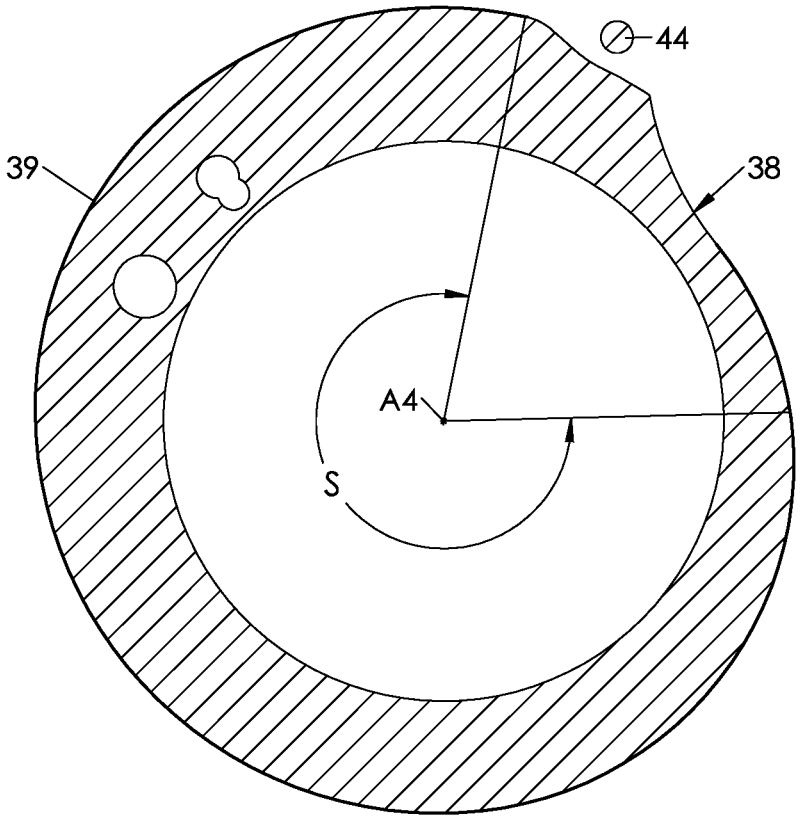
FIG. 6 is a drawing illustrating the shape of the cam path.
Figure 9:
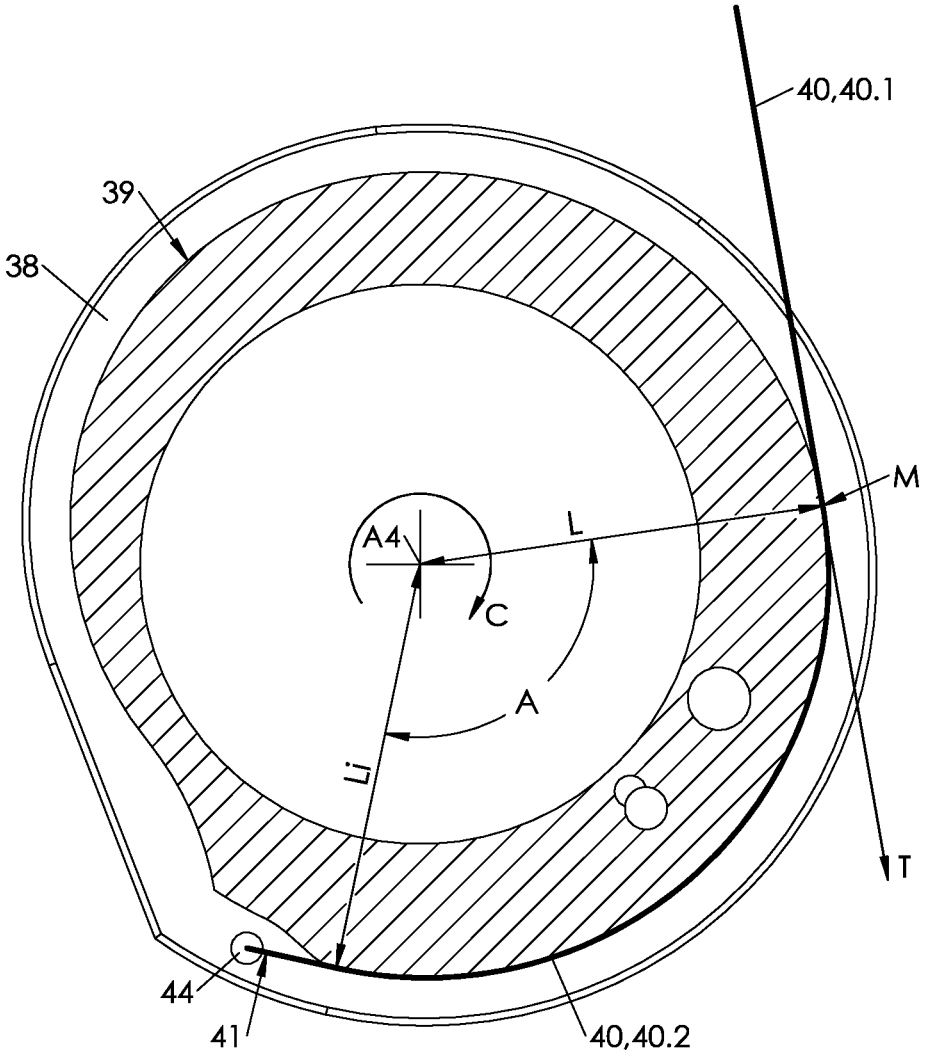
FIGS. 9, 10 and 11 are similar views to FIG. 8, illustrating the gradual winding of the chain on the pulley.
Figure 10:
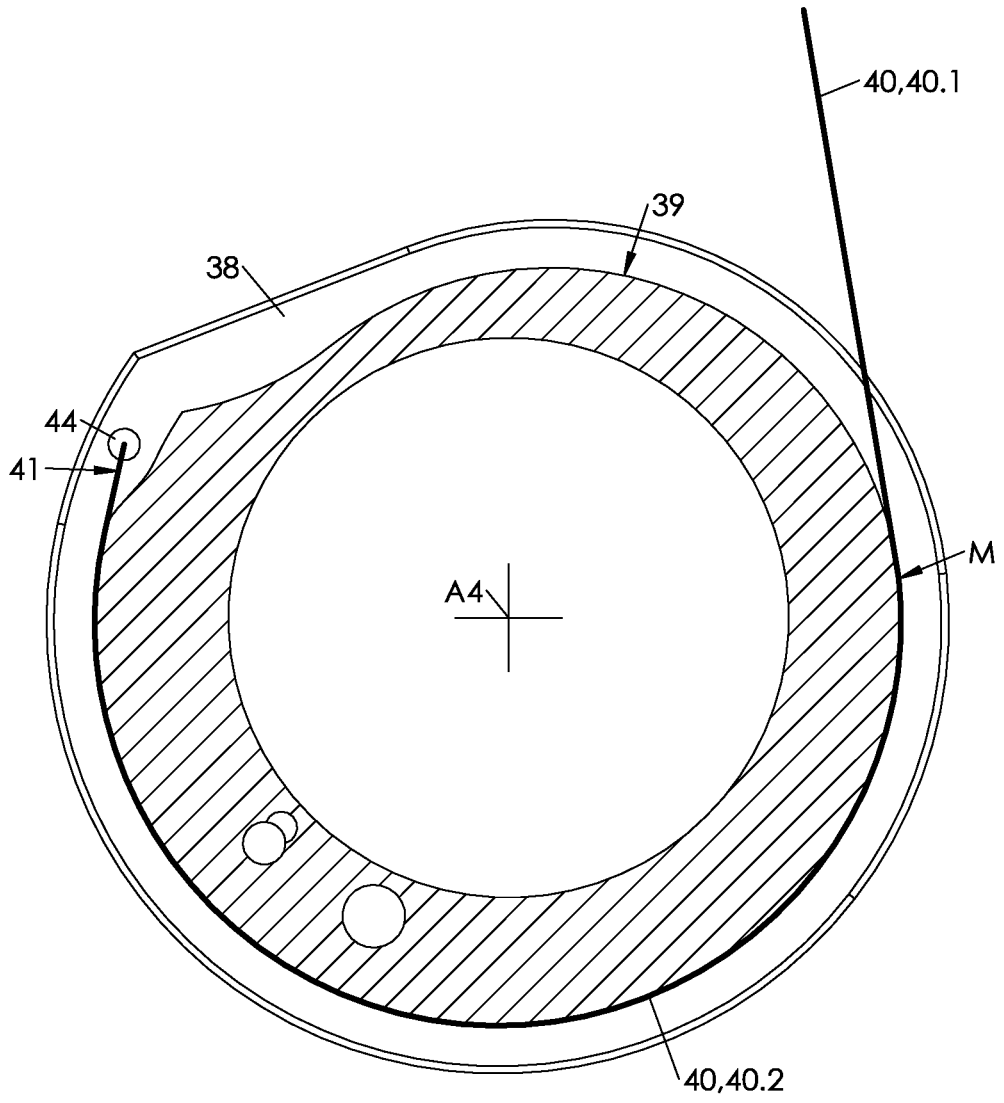

An example structure of cam path 39 is illustrated in the drawings, and more particularly in FIG. 6. In this example, cam path 39 extends over an angular sector S whose amplitude is less than 360° (i.e. cam path 39 is arranged to perform its function in less than one revolution of pulley 38 about barrel axis A4).

In the example illustrated in FIGS. 7 to 10, which corresponds to a pulley whose variations of lever arm L are illustrated in FIG. 6, the amplitude of the angular travel of pulley 38 is around 270°.

The advantages of this structure have already been mentioned and are as follows:

- minimising frequency variations (i.e. the number of chimes per second—or per minute) of the repeater chimes,
- minimising variations in forces in the chain. It is to be noted that this has the effect of limiting mechanical fatigue in the chain, and thus of increasing its lifetime.

It will be noted that the structure that has just been described may have variants without departing from the scope of the invention.

Thus, it is possible to envisage replacing barrel 32 with another sub-assembly having the same drive function. Such a sub-assembly includes, for example, a strip spring that works by bending, and to which pulley 38 is coupled by means of one or more connecting parts that transform the bending motion of the strip spring into a rotational motion of pulley 38. The function of such a strip spring is the same as that of mainspring 35: driving hour rack 10 towards its rest position via pulley 38 and chain 40.

What is claimed is:

1. A repeater mechanism for a striking timepiece, comprising:

an hour snail, an hour rack carrying an hour beak and rotatably mounted about an hour axis between:

a rest position in which the hour beak is angularly separated from the hour snail, and a read position in which the hour beak comes into contact with the hour snail, an hour spring, which returns the hour rack to the read position, a pulley rotatably mounted about a pulley axis, a chain configured to be partially wound on the pulley, the chain being hooked, by a proximal end, on the pulley and by a distal end on the hour rack, and a return spring coupled to the pulley, wherein the pulley is configured to pull the hour rack, via the chain, into the rest position, and the pulley forms a peripheral cam path which extends in a spiral around the pulley axis.

2. The repeater mechanism according to claim 1, wherein the pulley and the chain together form, on the cam path, a contact point whose distance to a barrel axis decreases with the winding of the chain.

3. The repeater mechanism according to claim 2, wherein a variation in the distance from the contact point to the barrel axis varies in a proportion comprised between 5% and 20%.

4. The repeater mechanism according to claim 1, wherein a variation in a distance from a contact point to the pulley axis as a function of the winding of the chain is linear.

5. The repeater mechanism according to claim 1, comprising:

a striking barrel including:

a barrel arbor which forms a barrel axis coincident with the axis of the pulley, a barrel drum, and said return spring whose inner end is integral with the barrel arbor and outer end is integral with the barrel drum, wherein, said pulley is rotationally coupled to said return spring.

6. A timepiece, comprising the repeater mechanism according to claim 1.

7. The timepiece according to claim 6, wherein the timepiece is a watch.

* * * * *